United States Patent [19]

Kuhn

[11] Patent Number: 4,468,037

[45] Date of Patent: Aug. 28, 1984

[54] CARD GAME USING TRANSPARENT PLAYING CARDS WITH OPAQUE INDICIA

[76] Inventor: A. Kenneth Kuhn, 5678 Alomar Dr., Cincinnati, Ohio 45238

[21] Appl. No.: 429,025

[22] Filed: Sep. 30, 1982

[51] Int. Cl.[3] ..... A63F 1/02

[52] U.S. Cl. ..... 273/295

[58] Field of Search ..... 273/295, 292, 293, 294, 273/309, 285, 286

[56] References Cited

U.S. PATENT DOCUMENTS

| | | | |
|---|---|---|---|
| 1,708,318 | 4/1929 | Little | 273/309 |
| 1,766,465 | 6/1930 | Snelling | 273/293 |
| 2,228,486 | 1/1941 | Reichert | 273/292 X |
| 2,911,220 | 11/1959 | Irwin | 273/293 |
| 3,245,687 | 4/1966 | Irwin | 273/293 |
| 3,263,999 | 8/1966 | McCoy | 273/293 |
| 3,645,534 | 2/1972 | Weisbecker | 273/293 X |
| 3,652,086 | 3/1972 | Stecker | 273/292 |
| 3,667,757 | 6/1972 | Holmberg | 273/285 X |
| 3,806,127 | 4/1974 | Pink | 273/294 |
| 4,140,320 | 2/1979 | Cortimilia | 273/293 |

*Primary Examiner*—William H. Grieb

*Attorney, Agent, or Firm*—Frost & Jacobs

[57] ABSTRACT

A card game containing a plurality of transparent playing cards. Each playing card has a like number of similarly located playing sections with one or more indicia located within the playing section. Guide means, such as a plurality of guide cards or a table covering, are used to align each participant's playing cards. Some guide cards have one or more markings located thereon which, in the play of the game, serve the same function as the indicia on the playing cards. During the play of the game, each participant attempts to play his playing cards directly down upon each other in overlying relationship in such a manner that the indicia on two or more playing cards are not superimposed.

17 Claims, 8 Drawing Figures

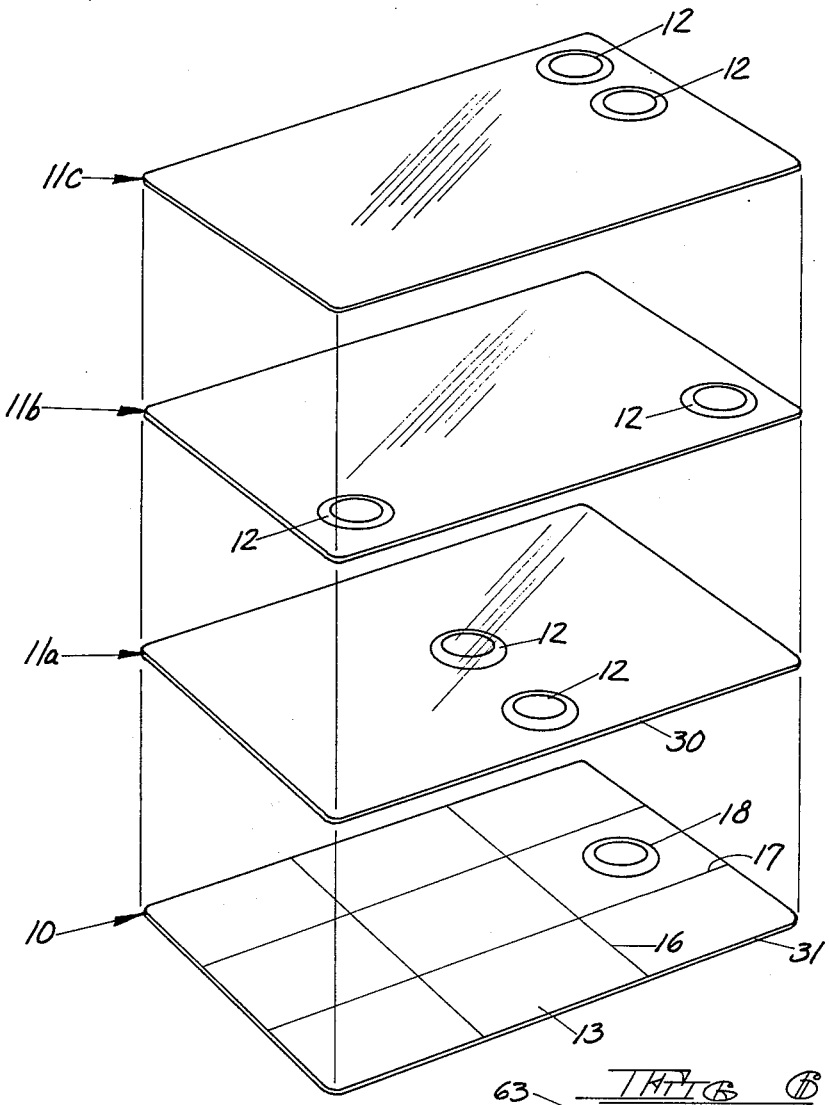
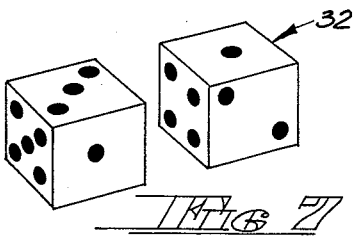
FIG 7
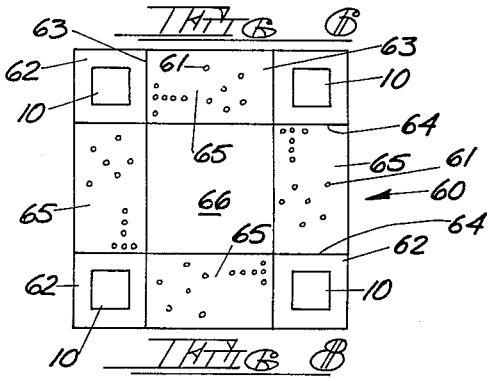
FIG 8

CARD GAME USING TRANSPARENT PLAYING CARDS WITH OPAQUE INDICIA

TECHNICAL FIELD

The present invention relates to a card game, and more particularly to a card game played by superimposing a plurality of transparent playing cards, each having one or more opaque indicia thereon, in such manner as to avoid placing playing cards on one another with aligned opaque indicia.

For decades, various types of card games have amused and entertained both adults and children. There is a continuing need for such games which can provide entertainment to a broad variety of individuals. Adults and children generally enjoy partaking in card games which combine the elements of luck and skill since the outcome of the game is never certain and, hence, they do not readily get bored with the game. Above all, however, the card game should be enjoyable and entertaining to play even after the game is played several times so that the players do not get tired with the game and, hence, abandon it. Card games combining skill and luck usually reward the participant who possesses superior playing and strategic skills, while also allowing the less skillful participant a chance of winning the game due to the fortunes of chance. Games which rely both on skill and chance for their outcome encourage even those uninitiated or unfamiliar with the game to join in the play of the game. Likewise, a card game should be easy to learn so that even those relatively uneducated in the rules of the game can quickly and easily learn to play the game.

BACKGROUND ART

Prior card games and card puzzles have used various types of transparent and/or opaque playing cards in overlying relationship to form various configurations. Often, the winning participant is determined by the formation of a predetermined pattern or arrangement of cards. For example, the card game described in U.S. Pat. No. 4,140,320 issued to Richard A. Cortimilia shows a card game in which playing cards having only one opaque indicia each are continuously overlayed onto each other until one of the players obtains a pattern resembling that of the well known game Bingo. The player has no choice on how to play his newly drawn card since the top of the card is clearly marked. Similarly, the card game taught in U.S. Pat. No. 3,806,127 issued to William Barrington Pink discloses a card game in which triangular playing cards, each having various colored circular portions, are played in overlying relationship to each other to create numerous color matches.

However, these and other prior art card games fail to provide the desired mixture of skill and chance to the participants. Similarly, these prior art card games lack flexibility and diversity in play so as to be enjoyable and entertaining to the participants even after the game is played numerous times. Many of these prior art games repeatedly present to the players the same set of game situations so that the player quickly masters the game and, hence, he becomes tired of the game. Even one who has achieved a significant level of skill in the prior art games quickly becomes bored with the games since they fail to provide new challenges.

DISCLOSURE OF THE INVENTION

To eliminate these inherent problems presented by prior art card games, the card game of the present invention incorporates into the play of the game a delicate balance between the elements of skill and chance. To be successful at the present card game, the players must possess a certain requisite level of skill. However, even one who has thoroughly mastered the card game of the present invention may still lose since there is enough of a luck factor incorporated into the game so that no particular outcome is certain. The card game entertains the participants even after many plays since the various possible alignments of the cards present innumerable game situations which continually challenge the participants. Even with this flexibility of play, however, the card game is relatively easy to learn and master so that a wide range of ages and educational backgrounds, such as a family, may enjoyably play the game together.

In a preferred embodiment of the card game of the present invention, the card game has a plurality of playing cards with each playing card being made from a transparent material. Each playing card is of the same size and it is divided into a like number of playing sections. The playing sections of each playing card are similarly located on all of the playing cards. One or more opaque indicia are located on each playing card. Each opaque indicia is positioned within a playing section of the playing card. More than one playing card can have the opaque indicia within a similarly located playing section so that when the playing cards are laid on top of each other, the opaque indicia within similarly located playing sections will overlie one another. Additionally, the card game may contain a plurality of guide cards with each guide card having a plurality of guide sections. The guide cards are the same size as the playing cards. The number and location of the guide sections on each guide card correspond in number and location to that of the playing sections on each playing card. Further details of the present invention will become apparent from a study of the following specifications, drawings and claims.

BRIEF DESCRIPTION OF THE DRAWINGS

FIG. 6 is an exploded perspective view of a plurality of the playing cards of the present invention being played in overlying relationship upon a guide card.

FIG. 7 depicts a pair of dice.

FIG. 8 is a top plan view of an alternative embodiment of the present invention using a table covering.

DESCRIPTION OF THE PREFERRED EMBODIMENT

Figures 1, 2, 3, 4, 5:
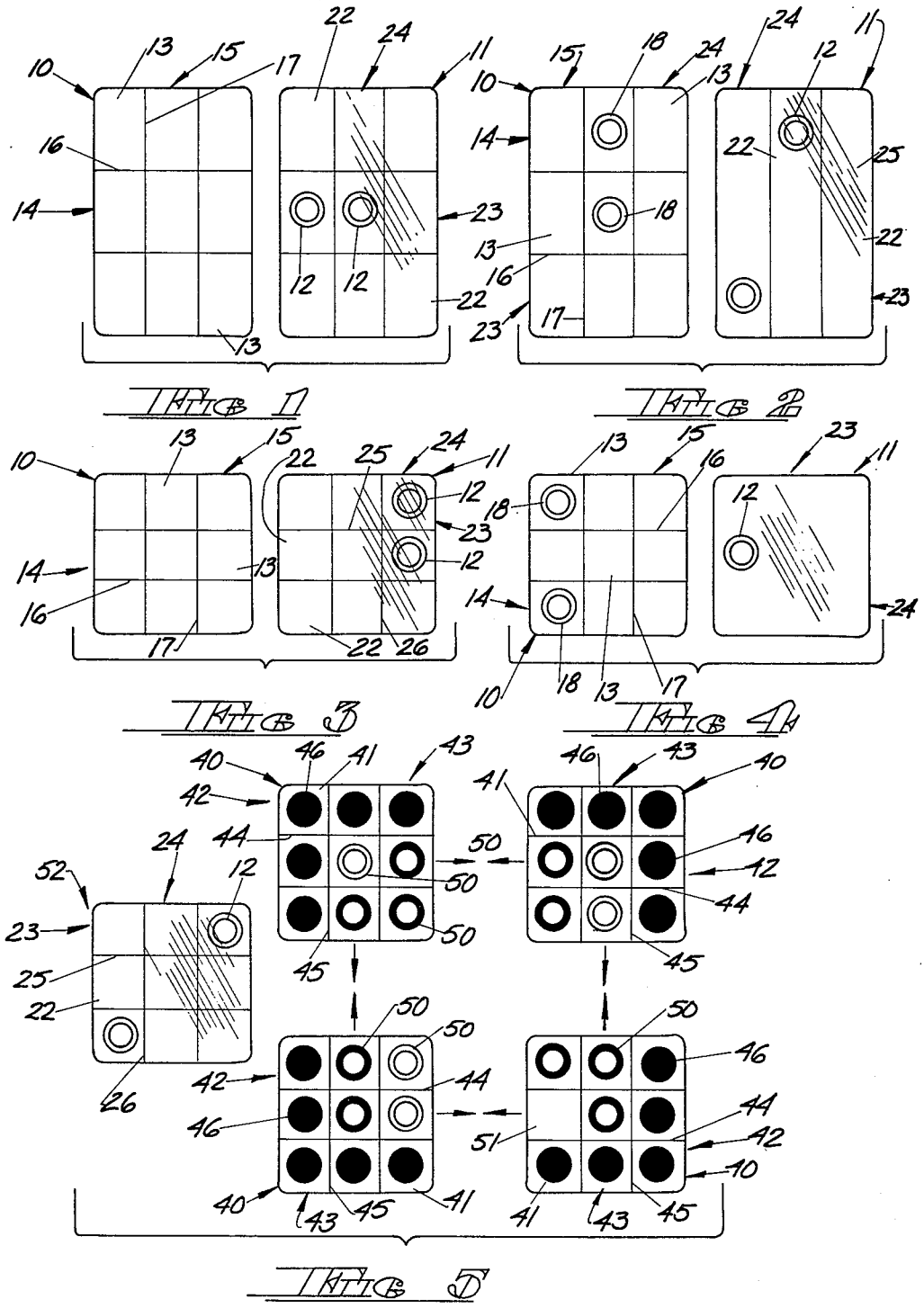
FIG. 1 is a top plan view of a guide card and a transparent playing card, the latter having certain opaque indicia depicted therein in an exemplary pattern in accordance with the invention.
FIG. 2 is a top plan view of a guide card with markings and a transparent playing card with opaque indicia, the latter illustrating a different pattern.
FIG. 3 is a top plan view of a square guide card and a transparent square playing card, the latter again having opaque indicia therein in yet another pattern.
FIG. 4 is a top plan view of a square guide card with markings and a transparent square playing card with opaque indicia.
FIG. 5 is an alternative embodiment of the present invention showing a transparent square playing card with opaque indicia and four guide cards with border indicia.

Referring now to FIG. 1, the preferred embodiment of the card game of the present invention is shown. Essentially, the present card game includes a plurality of guide cards 10 and a plurality of playing cards 11. The playing cards 11 are made from a transparent substance, such as a clear plastic, and each playing card 11 contains one or more indicia 12. Preferably, the indicia 12 are opaque. The size of each guide card 10 and playing card 11 are made so as to correspond to each other.

The guide cards 10 are made preferably from cardboard, but various paper, plastic and opaque compositions may be used as long as the requisite durability, rigidity and solid background are provided. The shape of the guide card 10 may be either oblong, as shown in FIGS. 1 and 2, or square, as illustrated in FIGS. 3 and 4. Each guide card 10 is divided into a plurality of guide sections 13. The guide sections 13 are arranged in rows 14 and columns 15. Preferably, there will be three rows 14 and three columns 15 of guide sections 13 per guide card 10. Hence, the preferred guide card 10 will have a total of nine guide sections 13. Each guide section 13 is preferably separated and differentiated from the other guide sections 13 on a particular guide card 10 by various horizontal lines 16 and various vertical lines 17. These lines aid in positioning and aligning properly the playing cards 11 upon the guide card 10.

The guide sections 13 can be made either all blank as shown in FIGS. 1 and 3 or partially filled by markings 18 as illustrated in FIGS. 2 and 4. These markings 18 may be various types of dots or circles. One or more guide sections 13 on the same guide card 10 can be filled by the markings 18. The markings 18 are positioned strategically on the guide card 10 so as to provide a challenge to the participants as they attempt to place a playing card 11 on the guide card 10 without playing an opaque indicia 12 of the playing card 11 over a marking 18. Essentially, the markings 18 are substantially the same as the indicia 12.

One or more indicia 12 are located within various playing sections 22 on each playing card 11. The playing sections 22 may be arranged in rows 23 and columns 2, see FIG. 3. The individual playing sections 22 may visibly be separated from each other, as shown in FIGS. 1 to 3, by horizontal lines 25 and vertical lines 26. However, such demarkation is not necessary for the effective play of the game, since, as shown in FIG. 4, the playing card 11 can be made without the horizontal and vertical dividing lines 25 and 26. When the playing cards 11 lack the horizontal and vertical lines 25 and 26, the shape of the guide cards 10 help the participants align the playing sections 22 of the playing cards 11 with the guide sections 13 of the guide card 10 as the playing card 11 is placed on the guide card 10. Otherwise, when both the guide cards 10 and playing cards 11 contain horizontal and vertical lines, then the horizontal lines 25 of the playing cards 11 are aligned with the horizontal lines 16 of the guide cards 10 and the vertical lines 26 of the playing cards 11 are aligned with the vertical lines 17.

Indicia 12 are located within one or more of the playing sections 22 on each playing card 11. The indicia 12 are placed in various combinations of playing sections 22 on each playing card 11 so that not all of the playing cards 11 within the card game are in the same pattern. Preferably, the indicia 12 are opaque. For example, FIG. 4 illustrates a playing card 11 having only one indicia 12, whereas FIGS. 1 and 3 show two indicia 12 adjacently positioned. Similarly, playing cards 11 can contain three, four or more indicia 12 on the same playing card 11. However, as will become evident from the rules of the game, when the playing cards 11 each contain a number of opaque indicia 12, the successful play of the game by the players becomes more difficult since the possibility of properly laying the playing card 11 onto the guide card 10 decreases.

The rules and object of the card game of the present invention are relatively simple so that a broad range of individuals may easily enjoy the play of the game. The object of the game is to fill the most guide sections 13 on a guide card 10 with indicia 12 by placing one or more playing cards 11 in overlying relationship onto the guide card 10 without placing two or more indicia 12 on top of each other. Similarly, if the guide card 10 has one or more markings 18, then the player strives to fill as many guide sections 13 on the guide card 10 with as many indicia 12 or markings 18 without placing two or more indicia 12 or an indicia 12 and a marking 18 in overlying relationship. Essentially, in the play of the game, a marking 18 counts like an indicia 12 as a participant determines the play of his cards to avoid placing one or more indicia 12 or markings 18 within the same guide sections 13.

FIG. 6 illustrates the play of the game with three playing cards 11, labeled **11*a*, 11*b* and 11*c*, to indicate the order with which they are played onto the guide card 10. The playing cards 11 can either be oblong, as shown in FIG. 6**, or square.

As shown in FIG. 6, when the participant is dealt the first playing card **11*a*, he places the playing card 11*a* down onto the guide card 10 in such a manner that each indicia 12 of the playing card 11*a* overlies a guide section 13. Since the playing cards 11 illustrated in FIG. 6 are oblong, the participant only has four choices as to the manner he may place the playing card 11 onto the guide card 10. The player may turn the playing card 11 through 180° and over to its opposite side. If the playing cards 11 are square, the player has eight choices in that they can be turned through 270°, as through three quarter-turns of 90°, and over to the opposite side. However, playing card 11*a* must be aligned onto the guide card 10 so that the playing card 11*a* completely overlies the guide card 10. The edges 30 of the playing card 11*a* are to rest on the edges 31 of the guide card 10. If the first dealt playing card 11*a* has horizontal 25 and vertical 26 lines, then alignment of the edges can be easily obtained by placing these lines directly onto the horizontal 16 and vertical 17 lines of the guide card 10**.

When a second playing card **11*b* is given to the participant, he must place the newly dealt playing card 11*b* onto the already played first card 11*a* in such a manner that the indicia 12 of the playing card 11*b* does not overlie an indicia 12 on playing card 11*a* or a marking 18, if any, on the guide card 10. As with playing card 11*a*, the newly drawn playing card 11*b* can be rotated through 180° and turned over so as to provide various options in how to overlie the new card 11*b* onto the already played cards If a participant cannot place the newly drawn 11*b* onto the playing card 11*a* without having one or more indicia 12 or markings 18 overlap, then that participant is eliminated from that hand or round of the game and, hence, he cannot accumulate any points in that round. If a participant successfully places his newly drawn card 11*b* onto the played card 11*a*, then he may be dealt a third playing card 11c. Again, in the manner previously described, in order to remain in the round or hand, he must successfully position this third played card 11c onto playing cards 11b and 11a without having any of the indicia 12 overlap each other or overlap markings 18, if any, on the guide card 10**.

The dice 32 determine the order of play of the game. The participant rolling the highest number of the dice 32 is dealt a playing card 11a. The participants, in turn, each receive a playing card 11a in order from highest to lowest dice roll. Play continues in the order as determined by the initial die roll until one or more participants has completed filled all nine guide sections 13 on the guide card 10 with indicia 12 or markings 18 without any of them being played in overlying relationship. If two or more players have obtained such a filled guide card 10, then the tied players roll the dice 32 to determine the winner of the hand with the player rolling the lowest value being declared the winner. If, prior to one player completely filling his guide card 10, all participants cannot play their playing cards 11 without overlapping the indicia 12 or markings 18, then the winner of the hand or round is the last remaining participant after everyone else has been eliminated from the round or hand by overlapping the indicia 12 or markings 18.

The card game can be played so that when it is time for a participant to receive a newly dealt playing card 11, he may announce that he is "passing". Hence, he will not receive a newly dealt playing card 11. The passing player may return to play at any time when one or more other players equal the passed player in indicia 12 or markings 18 count and these players have also similarly passed. A passing player may win the round or hand if all other players were eliminated due to overlapping indicia 12 or markings 18. If two or more players have passed and remain in the hand or round when all the other players are eliminated, then the passing players roll the dice 32 to determine the order they will receive newly dealt playing cards 11. Play continues to the time when either one of the players properly fills his guide card 10 or all but one of the players have been eliminated.

The participant who wins the round or hand receives one point for each indicia 12 or marking 18 properly played. If the winning participant has properly filled all of the guide sections 13 on his guide card 10, then his score is doubled. The winning participant of the round or hand, however, has the option of engaging in post-game play. In post-game play, the participant can choose either to attempt to roll a double on the dice 32 or to be dealt more playing cards 11 so as to fill up all nine of his guide sections 13. However, the former option is available to the player only when he has won the regular game play by completely filling in his playing cards 11. If a participant rolls doubles on the dice 32, then his winning score of the round is doubled. If a player attempts to complete his guide card 10, then he receives two points for each properly played indicia 12. If he completely fills his guide card 10, then his winning score plus the post-game play score is doubled. In post game play, if a player fails to successfully draw a playable card, or fill all guide sections 13 or playing sections 22, or roll a double with the dice 32, the player sacrifices all scoring points obtained in that round of play.

After this phase of post-game play, all participants again join in playing a new round or hand of the card game in the manner previously described. Play of the round continue until either one participant obtains a preselected score or a set time limit has expired. Prior to the play of the game, the participants decide whether the winner is to be the one who equals or exceeds the preselected score, or whether the winner is to be the one who obtains exactly the pre-selected score. The player with the preselected score or highest score at the end of the alotted time is declared the winner.

Referring now to FIG. 5, another variation of the card game of the present invention is shown. This variation of the card game includes a plurality of bordered guide cards 40. Each guide card 40 is divided into nine guide sections 41 consisting of three rows 42 and three columns 43. Horizontal lines 44 and vertical lines 45 delineate the various guide sections 41. Five border indicia 46 are continuously arranged on each guide card 40 along an outer row 42 and an outer column 43. The five border indicia 46 form an L-shape on the guide card 40. Each game participant receives four guide cards 40 and he arranges them in such a manner, as shown in FIG. 5, that the border indicia 46 of the four cards form an outer boundary.

As shown in FIG. 5, each guide card 40 has four guide sections 41 not filled by border indicia 46. These four spaces are either filled by guide indicia 50 or remain blank spaces 51. The guide indicia 50 is a circle of either one of two different colors. For example, some of the guide indicia 50 can be black circles and others can be red circles. The blank space 51 constitutes a "wild space" and, hence, it can represent either of the two differently colored guide indicia 50.

The variation of the card game depicted in FIG. 5 has a plurality of playing cards 52. Each playing card 52 is similar to the playing cards 11 shown in FIG. 3. Each playing card 52 has one or more indicia 12 occupying the various playing sections 22. The guide cards 40 and playing cards 52 can either be square, as shown in FIG. 5, or oblong. If oblong cards are used, the border indicia 46 and colored guide indicia 50 are marked on both sides of the guide card 40 so that one side of the guide card 40 is a mirror image of the other side.

In the play of the game shown in FIG. 5, each participant initially receives four guide cards 40 which he positions together so that the border indicia 46 on each guide card 40 form a continuous outer boundary. Each participant then receives in turn a playing card 52. The participant must place the playing card 52 on top of the guide cards 40 so that the indicia 12 of the playing cards 52 lie in overlapping relationship with the guide indicia 50. The color of the guide indicia 50 need not match the color of the indicia 12, but rather the color of all guide indicia 50, on which the indicia 12 of a particular playing card 11 lies, must be the same. As with the variations shown in FIGS. 1 to 4, the playing card 52 cannot be played so that it extends beyond the outer edges of any of the guide cards 40. The playing cards 52, however, can be played to overlie on any nine guide sections 41 of the four arranged-together guide cards 40 so long as an indicia 12 on the playing card 52 does not overlap a border indica 46.

The winner of the variation shown in FIG. 5 is the first player to cover properly all of the guide indicia 50 on the four guide cards 40. The winning participant obtains a score equivalent to the number of guide indicia 50 and blank spaces 51 remaining uncovered on the other participant's guide cards 40. Dice 32 and post-game play can be incorporated into the rules of the game as previously described for the variations shown in FIGS. 1 to 4.

A further variation of the card game, as shown in FIG. 8, can be played by using a table covering 60 having four playing zones 65. The table covering 60 is placed upon a table or similar surface and each player has a playing zone 65 containing indicia 61 onto which he is to place his playing cards 11. The table covering can have a felt-like backing so that it does not slip from the table during play of the game. The playing zones 65 can be differentiated from each other by vertical lines 63 and horizontal lines 64. Within each of the four corners of the table covering 60, there is located a guide card zone 62 onto which the guide cards 10 can be placed in playing any of the variations depicted in FIG. 1 to 5. A center zone 66 is located in the central area of the table covering 60 and the various playing decks can be placed therein. When the embodiment shown in FIG. 8 is played, the playing cards 11 preferably have a colored border along the four edges 30 so as to establish a guide upon which the further dealt playing cards 11 can be overplayed.

Other changes can be incorporated into the rules of the card game of the present invention to provide variety of play. For example, one or more of the playing cards 11 can be marked so as to be a wild card and, hence, capable of being played on the guide card 10 in any manner the player may choose. Additionally, the game of the present invention can use various types of chips or tokens to incorporate a betting or wagering aspect into the play of the game. The winner of a round obtains the chips or tokens placed in a pot by the other players.

What is claimed is:

1. A card game comprising:

(a) a plurality of playing cards, each playing card being of the same size and made from a transparent material, each playing card being divided into a like number of playing sections, the playing sections being similarly located on all of the playing cards;

(b) one or more indicia located on each playing card, each indicia being positioned within a playing section of the playing card, one or more playing cards having an indicia within a similarly located playing section; and (c) guide means for aligning the playing cards in overlying relationship, said guide means comprising a plurality of guides cards, each guide card being of the same size as the playing cards, each guide card being divided into a like number of guide sections, the number of guide sections on each guide card corresponding in number to the number of playing sections on each playing card, the guide sections being located on each guide card to correspond to the locations of the playing sections on each playing card so that when a playing card is laid upon a guide card, the playing sections are in overlying relationship with the guide sections.

2. The card game as described in claim 1, wherein the guide sections on each guide card are arranged into an equivalent number of rows and columns.

3. The card game as described in claim 2, wherein each guide card has a plurality of intersecting vertical and horizontal lines differentiating the guide sections on each guide card from each other.

4. The card game as described in claim 1, wherein one or more markings are located within one or more guide sections on each guide card.

5. The card game as described in claim 1, wherein the guide cards are made from cardboard.

6. The card game as described in claim 1, wherein the guide means is a plurality of intersecting vertical and horizontal lines corresponding to the playing sections on each playing card.

7. The card game as described in claim 1, wherein each playing card is square in shape.

8. The card game as described in claim 1, wherein each playing card is oblong in shape.

9. The card game as described in claim 1, wherein the playing sections on each playing card are arranged into an equivalent number of rows and columns.

10. The card game as described in claim 1, wherein the indicia on the playing cards are opaque.

11. The card game as described in claim 1, further comprising one or more dice for determining the winning participant.

12. The card game as described in claim 1, wherein each playing card is made from a plastic material.

13. A card game comprising:

(a) a plurality of guide cards, each guide card being of like dimensions, each guide card being divided into a like number of guide sections, the guide sections on each guide card being arranged into an equivalent number of rows and columns;

(b) a plurality of border indicia being located continuously within an entire outer row and an entire outer column of guide sections;

(c) one or more guide indicia located on each guide card, each guide indicia being located within a guide section not having a border indicia;

(d) a plurality of playing cards, each playing card being made from a transparent material, each playing card being of like dimensions equivalent to the dimensions of the guide cards, each playing card being divided into a like number of playing sections, the number of playing sections being equivalent to the number of guide sections on the guide cards, the playing sections on each playing card being located to correspond to the locations of the guide sections on each guide card, the playing sections being arranged into an equivalent number of rows and columns; and (e) one or more indicia located on each playing card, each indicia being positioned within a playing section of the playing card.

14. A set of rectangular transparent playing cards of the same size and adapted to be stacked in even alignment on one another; each said playing card having a plurality of playing sections thereon, all of said playing cards having the same number of playing sections thereon, said playing sections being in alignment when two or more of said playing cards are stacked evenly on one another; each said playing card having one or more opaque indicia thereon, each said indicia being located on its respective said playing card in a said playing section, some only of said indicia being in the same relative playing sections on their respective playing cards; and each said playing card being both rotatable and capable of being turned over so as to provide a plurality of positions for each said playing card while maintaining two or more of said playing cards stacked in even alignment so that said playing sections remain aligned; whereby when all of said playing cards are square, each said playing card has eight different positions in which it may be placed with respect to an adjacent playing card stacked in even alignment therewith, and whereby when all of said playing cards are oblong, each said playing card has four different positions in which it may be placed with respect to an adjacent playing card stacked in even alignment therewith, said indicia being so arranged on the said playing cards of a said set that eventually it will be impossible to rotate and turn a said playing card without having a said indicia thereon being in alignment with another said indicia on another said playing card stacked in even alignment therewith.

15. The set of claim 14 in combination with a guide means to aid in positioning the first said playing card to be drawn from said set, successive said playing cards drawn from said set to be placed over said guide means and said first playing card to form an evenly aligned stack of playing cards over said guide means.

16. The combination of claim 15 in which said guide means comprises a rectangular, opaque guide card of the same size as said playing card and having guide sections thereon corresponding to said playing sections.

17. The combination of claim 15 in which said guide means comprises a table covering having a rectangular guide zone marked thereon of the same size as a said playing card and having guide sections marked therein to correspond to said playing sections.

* * * * *